US008474363B2

(12) United States Patent
Kelly

(10) Patent No.: US 8,474,363 B2
(45) Date of Patent: Jul. 2, 2013

(54) AXIAL PISTON AND VALVE SHAFT FLUID ENGINE

(76) Inventor: Vincent M. Kelly, Prescott, AZ (US)

( * ) Notice: Subject to any disclaimer, the term of this patent is extended or adjusted under 35 U.S.C. 154(b) by 0 days.

(21) Appl. No.: 13/476,365

(22) Filed: May 21, 2012

(65) Prior Publication Data

US 2013/0031896 A1 Feb. 7, 2013

Related U.S. Application Data

(60) Provisional application No. 61/504,237, filed on Jul. 3, 2011, provisional application No. 61/513,972, filed on Aug. 1, 2011.

(51) Int. Cl.
*F01L 25/02* (2006.01)
*F01K 23/06* (2006.01)

(52) U.S. Cl.
USPC ..... 91/303; 91/325; 91/329; 91/348; 60/670

(58) Field of Classification Search
USPC ... 91/303, 325, 328, 329, 341 R, 348; 60/670
See application file for complete search history.

(56) References Cited

U.S. PATENT DOCUMENTS

| | | | | |
|---|---|---|---|---|
| 1,813,861 | A | | 8/1876 | Winchester |
| 931,449 | A | | 8/1909 | Mauss |
| 1,031,340 | A | | 7/1912 | Howard |
| 1,740,713 | A | | 12/1929 | Rundqvist |
| 2,722,919 | A | | 11/1955 | Kuhn |
| 2,862,478 | A | | 12/1958 | Staats |
| 3,329,094 | A | | 7/1967 | Harklau |
| 3,620,126 | A | | 11/1971 | Fuhrimann |
| 3,838,626 | A | | 10/1974 | Carter |
| 3,846,048 | A | | 11/1974 | Robbins, Jr. |
| 3,849,030 | A | | 11/1974 | McArthur |
| 3,896,889 | A | | 7/1975 | Bouyoucos |
| 3,903,972 | A | | 9/1975 | Bouyoucos et al. |
| 3,911,789 | A | | 10/1975 | Bouyoucos |
| 3,969,984 | A | | 7/1976 | Bouyoucos |
| 4,033,134 | A | * | 7/1977 | Bentley ..... 60/641.8 |
| 4,037,520 | A | | 7/1977 | Jakob |
| 5,564,912 | A | | 10/1996 | Peck |
| 6,123,008 | A | | 9/2000 | Scherer |
| 6,647,813 | B2 | | 11/2003 | Green |
| 7,322,560 | B2 | | 1/2008 | Gauss |
| 8,096,787 | B2 | | 1/2012 | Green |
| 2005/0123416 | A1 | | 6/2005 | Smith |
| 2009/0048038 | A1 | | 2/2009 | Eubanks |

OTHER PUBLICATIONS

Web Page: http://home.earthlink.net/~dlaw70/12stmng.htm.

* cited by examiner

*Primary Examiner* — Edward Look
*Assistant Examiner* — Logan Kraft
(74) *Attorney, Agent, or Firm* — Davis Wright Tremaine LLP; Bobby B. Soltani

(57) ABSTRACT

Systems and methods for implementing a uniflow fluid engine having at least one cylinder having at least one high-pressure input and at least one low-pressure output. In some embodiments, the engine includes piston-operated valves that are related to the piston shaft and pistons that may also act as exhaust valves. In some embodiments, a valve is slidably positioned within the cylinder on the piston shaft, the valve being movable between a first position allowing input fluid to be conveyed through a first passage and blocking input fluid from a second passage, and a second position allowing input fluid to be conveyed through the second passage and blocking input fluid from the first passage.

21 Claims, 14 Drawing Sheets

AXIAL PISTON AND VALVE SHAFT FLUID ENGINE

CROSS REFERENCE TO RELATED APPLICATIONS

This application claims priority to U.S. Provisional Application No. 61/513,972, filed Aug. 1, 2011, entitled "Piston-Operated-Valve Reciprocating Fluid Engine," which is hereby incorporated by reference in its entirety.

FIELD OF THE INVENTION

The present invention relates generally to systems and methods for providing power conversion utilizing elevated-pressure fluid sources, and more particularly, to axial piston and valve shaft fluid engines.

BACKGROUND OF THE INVENTION

The following description includes information that may be useful in understanding the present invention. It is not an admission that any of the information provided herein is prior art or relevant to the presently claimed invention, or that any publication specifically or implicitly referenced is prior art.

The consumer solar energy market currently emphasizes photovoltaic cells as a primary means to achieve residential, institutional, and small business solar electricity. Presently, photovoltaic cells are costly for power output and perceived longevity.

The energy industry typically burns fossil fuels to boil water to make steam to power electrical generators. In fact, greater than 80% of the world electricity production is steam generated. Steam turbines are considered most effective for greater than 1 megawatt (mW) of electrical generation, which corresponds to approximately 300 average U.S. households. Generally, a reciprocating steam engine is considered more efficient for applications that require less than 1 mW of electrical generation.

Traditionally, steam engines have been expensive or have required excessive maintenance due to custom, small-scale manufacturing, large numbers of moving parts, and/or the need to separate working and lubrication fluids that are merged during operation. Increasingly, a steam engine that has low cost and low maintenance requirements is becoming essential to future consumer and light industry solar markets, as well as other markets that may benefit from improved steam engines.

BRIEF DESCRIPTION OF THE DRAWINGS

Exemplary embodiments are illustrated in the referenced figures. It is intended that the embodiments and figures disclosed herein are to be considered illustrative rather than restrictive.

DESCRIPTION OF THE INVENTION

One skilled in the art will recognize many methods, systems, and materials similar or equivalent to those described herein, which could be used in the practice of the present invention. Indeed, the present invention is in no way limited to the methods, systems, and materials described.

Embodiments of the present invention are directed to fluid engines having at least one cylinder including at least one high-pressure input and at least one low-pressure output. The fluid engines include a valve, in the form of a shuttle plate or a cylinder, that is slidably positioned within the cylinder on a piston shaft. In some embodiments, the valve is movable between a first position wherein it allows an input fluid from a fluid input port to be conveyed through a first passage and blocks fluid flow between the fluid input port and a second passage, and a second position wherein the valve allows input fluid to be conveyed from the fluid input port through second passage and blocks fluid flow between the fluid input port and the first passage.

FIGS. 1A-1E illustrate partial cross-sectional views of an opposed cylinder, axial piston and shuttle valve fluid engine 10 in accordance with a first embodiment of the present invention when the engine is in various stages of its operation cycle. The engine 10 (also referred to as a "motor unit" or an "expander") comprises an elongated cylinder body 14 (or "cylinder") comprising a left cylinder base plate 18A and a right cylinder base plate 18B. Throughout the specification, the terms "left" and "right" refer to the exemplary views of the engines shown in the Figures.

The engine 10 also includes a power shaft 30 coupled to the cylinder base plates 18A and 18B by stuffing boxes 32A and 32B, respectively, disposed in respective apertures 20A and 20B of the cylinder base plates. The shaft 30 is also coupled to external linear bearings 36A and 36B, which allow the shaft to reciprocate. As shown, the linear bearings 36A and 36B are positioned outside of the cylinder 14, which allows lubricating materials to be kept outside of the cylinder.

The shaft 30 includes a left piston head 42A (or "piston") and a right piston head 42B fixedly attached thereto. As discussed below, fluid force on the pistons 42A and 42B operates to move the shaft 30 to expand the volume of a high-pressure chamber while decreasing the volume of a low-pressure chamber.

Figure 1A:
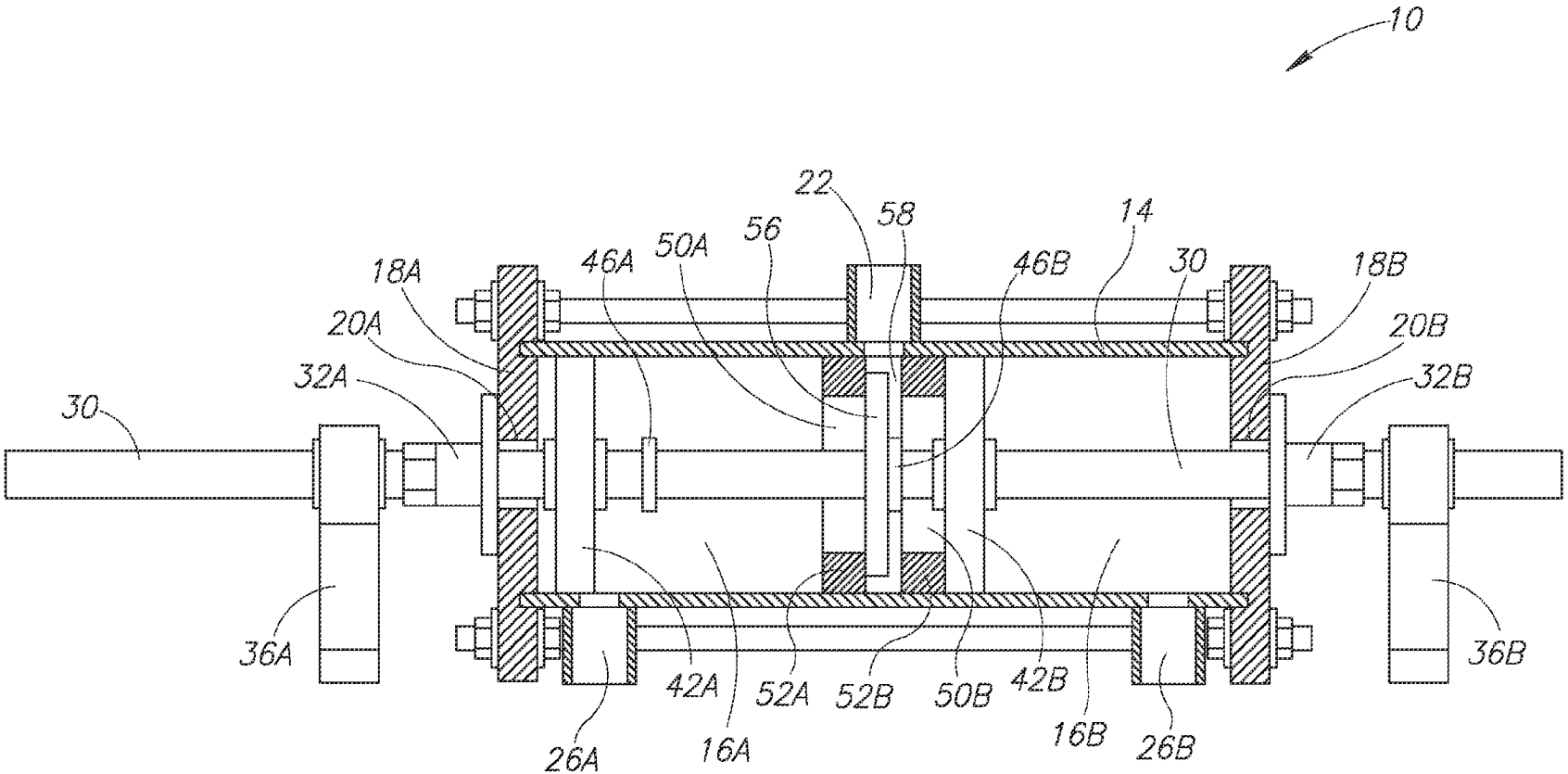
FIG. 1A illustrates an opposed cylinder, axial piston and shuttle valve fluid engine configuration in accordance with a first embodiment of the present invention when a right side piston is positioned in a retracted position at the beginning of an expansion stroke.
Figure 1B:
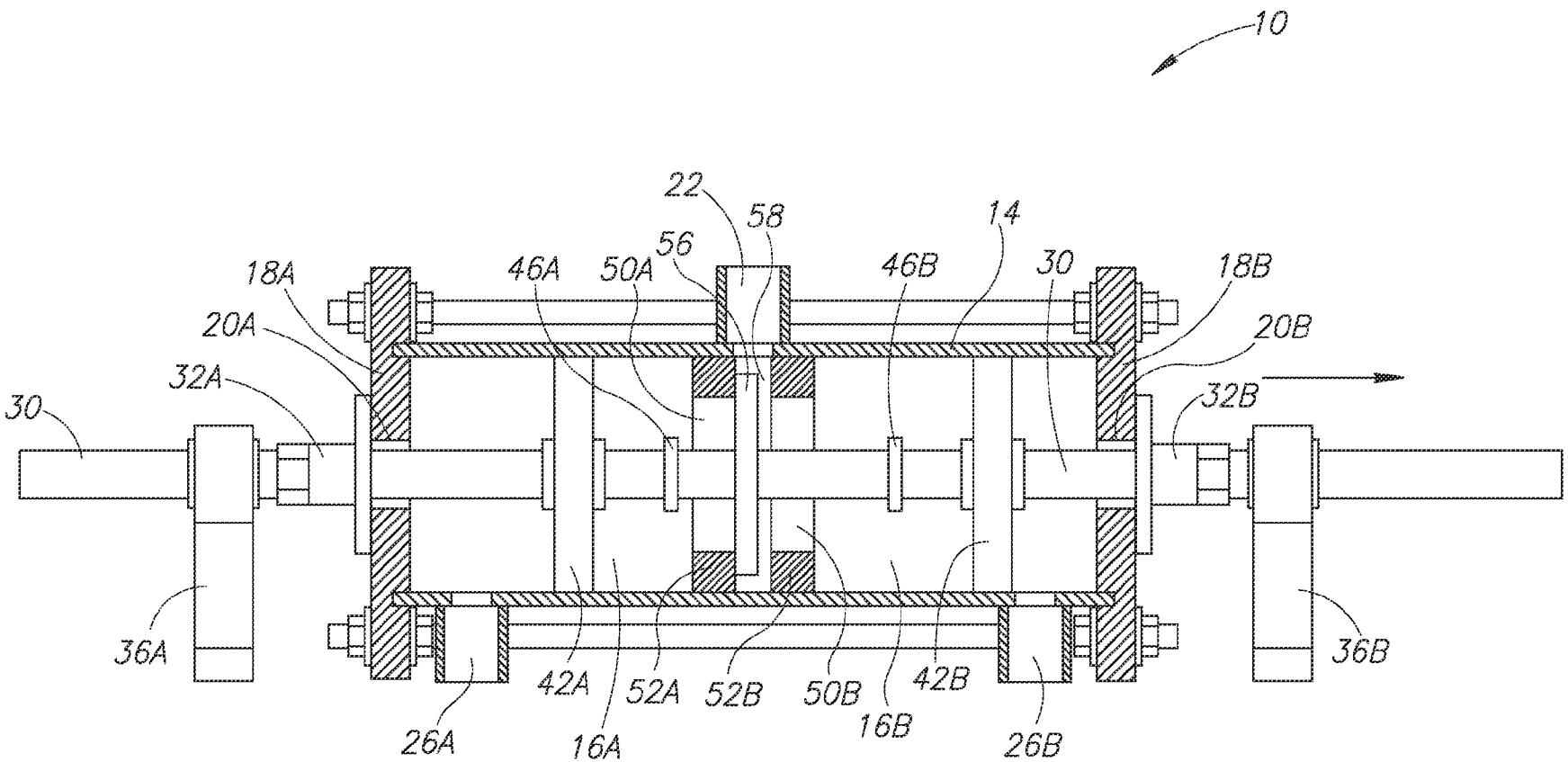
FIG. 1B illustrates the fluid engine of FIG. 1A when the right side piston is positioned between the retracted position and an extended or exhaust position during the expansion stroke.
Figure 1C:
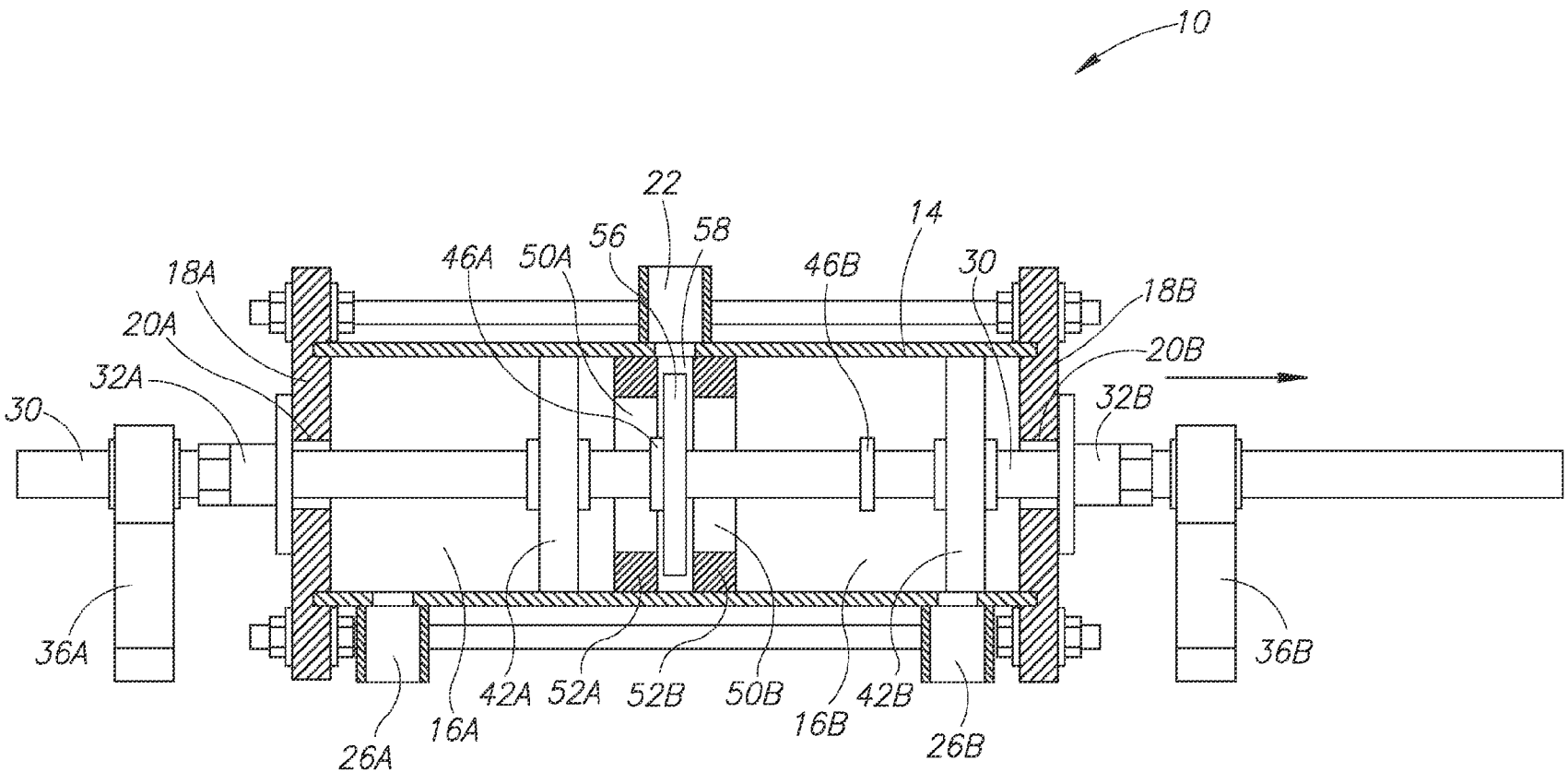
FIG. 1C illustrates the fluid engine of FIG. 1A when the right side piston is positioned in the extended position and a shuttle valve plate is in a transitional state.
Figure 1D:
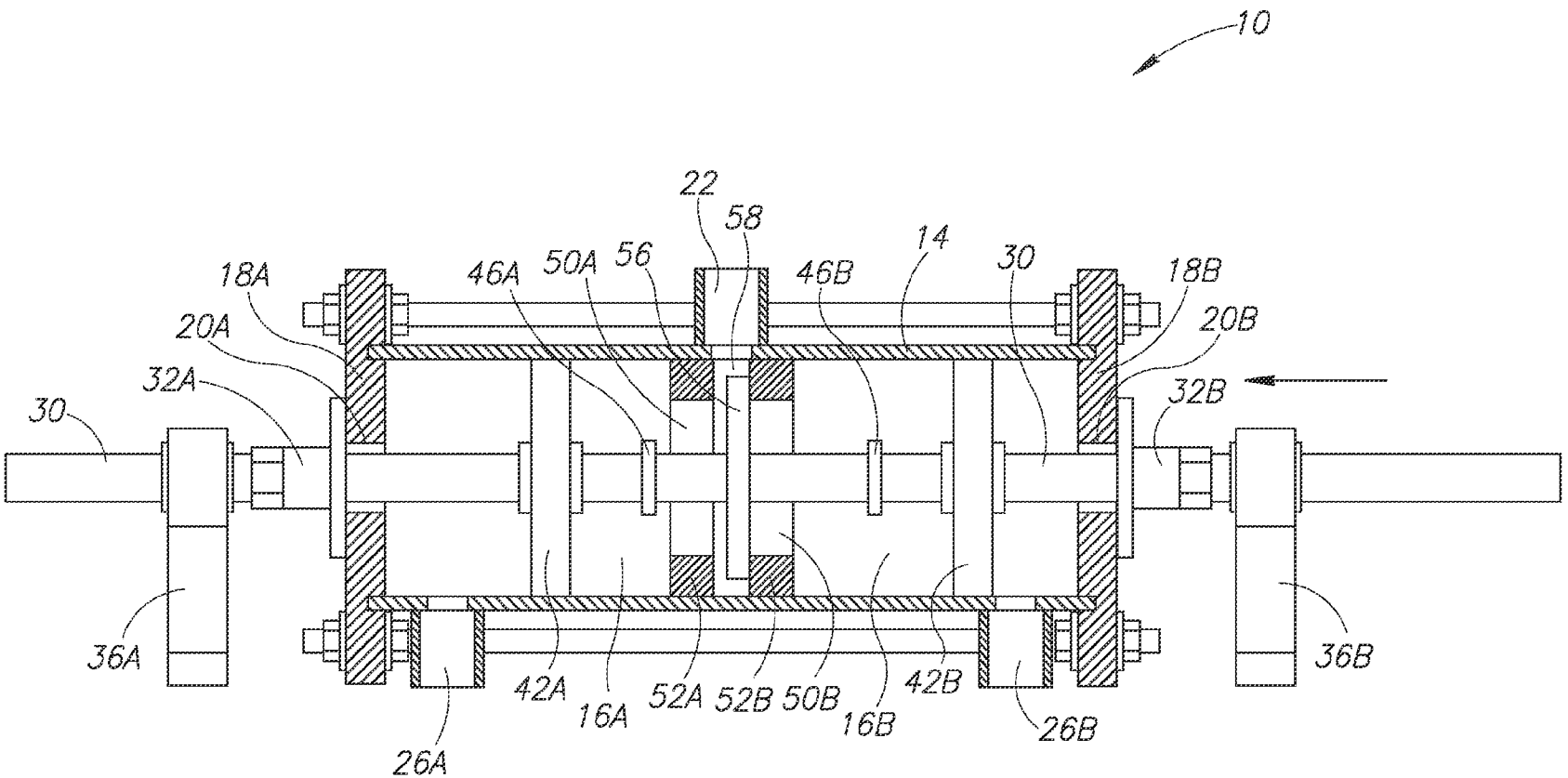
FIG. 1D illustrates the fluid engine of FIG. 1A when the right side piston is positioned between the retracted position and the extended or exhaust position during a retraction stroke.

The cylinder 14 also includes a left valve seal or seat 52A having an aperture 50A therethrough and a right valve seat 52B having an aperture 50B therethrough that are disposed on opposing sides of an inlet port 22. The inlet port 22 may be coupled to a pressurized fluid source. A shuttle valve plate 56 is slidably coupled to the shaft 30 and disposed between the left valve seat 52A and the right valve seat 52B. The valve seats 52A and 52B act to restrict the travel of the shuttle valve plate 56 and to restrict the travel of the pistons 42A and 42B and the shaft 30. The shuttle valve plate 56 and the valve seats 52A and 52B together function to allow high pressure to remain in one of a left fluid chamber 16A and a right fluid chamber 16B of the cylinder 14 during portions of the engine's operational cycle. As shown in FIG. 1A, an inlet fluid gap 58 is formed between the shuttle valve plate 56 and the right valve seat 52B so that fluid may flow from the inlet port 22 into the right fluid chamber 16B. Similarly, as shown in FIG. 1D, when the shuttle valve plate 56 is adjacent the right valve seat 52B, the inlet fluid gap 58 is formed between the shuttle valve plate 56 and the left valve seat 52A so that fluid may flow from the inlet port 22 into the left fluid chamber 16A.

A left valve driver 46A (or "shaft stop") and a right valve driver 46B are fixedly positioned on the shaft 30 on opposite sides of the shuttle valve plate 56. The right valve driver 46B is configured to force the shuttle valve plate 56 to the left until the shuttle valve plate is adjacent to the left valve seat 52A (see FIG. 1A) so that it blocks the flow of fluid into the left fluid chamber 16A. The left valve driver 46A is configured to force the shuttle valve plate 56 to the right until it is adjacent to the right valve seat 52B (see FIG. 1D) so that the shuttle valve plate blocks the flow of fluid into the right fluid chamber 16B.

The cylinder 14 of the engine 10 also includes a left exhaust port 26A and a right exhaust port 26B positioned proximate to the cylinder base plates 18A and 18B, respectively. The exhaust ports 26A and 26B are positioned such that the pistons 42A and 42B extend past the exhaust ports when in an extended position such that the pressurized fluid in the fluid chambers 16A and 16B may exhaust out of the ports 26A and 26B, respectively.

During operation, as shown in FIG. 1A, high-pressure fluid enters the inlet port 22 and is directed by the shuttle valve plate 56 into the lower pressure right fluid chamber 16B of the cylinder 14. As shown in FIGS. 1B and 1C, the high-pressure fluid causes the piston 42B to extend away from the inlet port 22 until the piston 42B extends past the exhaust port 26B at end of its stroke (i.e., "bottom dead center" or BDC). The higher pressure in the fluid chamber 16B retains the shuttle valve plate 56 in its position abutting the valve seat 52A as the right piston 42B extends to the right.

Figure 1E:
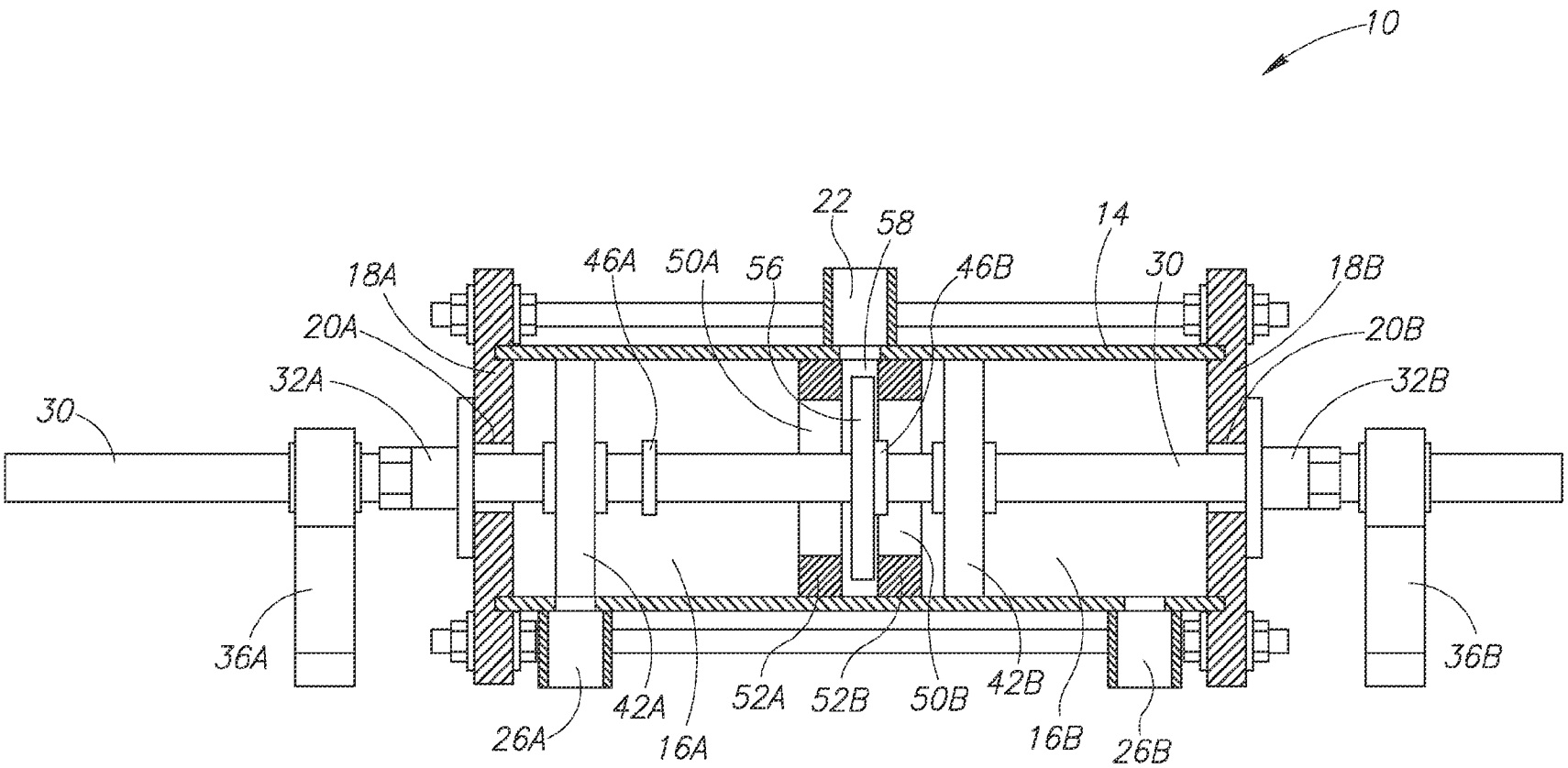
FIG. 1E illustrates the fluid engine of FIG. 1A when the right side piston is positioned near the retracted position and the shuttle valve plate is in a transitional state.

As shown in FIG. 1C, as the shaft 30 moves to the right, the valve driver 46A contacts and pushes the shuttle valve plate 56 to a second position where the flow of higher pressure fluid to the right fluid chamber 16B is cut off and the flow of higher pressure fluid to the left fluid chamber 16A is permitted. Then, as shown in FIG. 1D, the high pressure fluid forces the left piston 42A to expand leftward. As shown in FIG. 1E, the cycle of the engine 10 then repeats.

Although the valve drivers/shaft stops 46A and 46B are plates in the present embodiment, other implementations may be utilized. For example, each of the shaft stops may be a mechanical stop/piston/valve or may be a fluid buffer (e.g., a valve opening before end of a stroke). In some embodiments, a shaft spring may also be used to buffer the stop of the pistons 42A and 42B at the end of their strokes.

Figure 2:
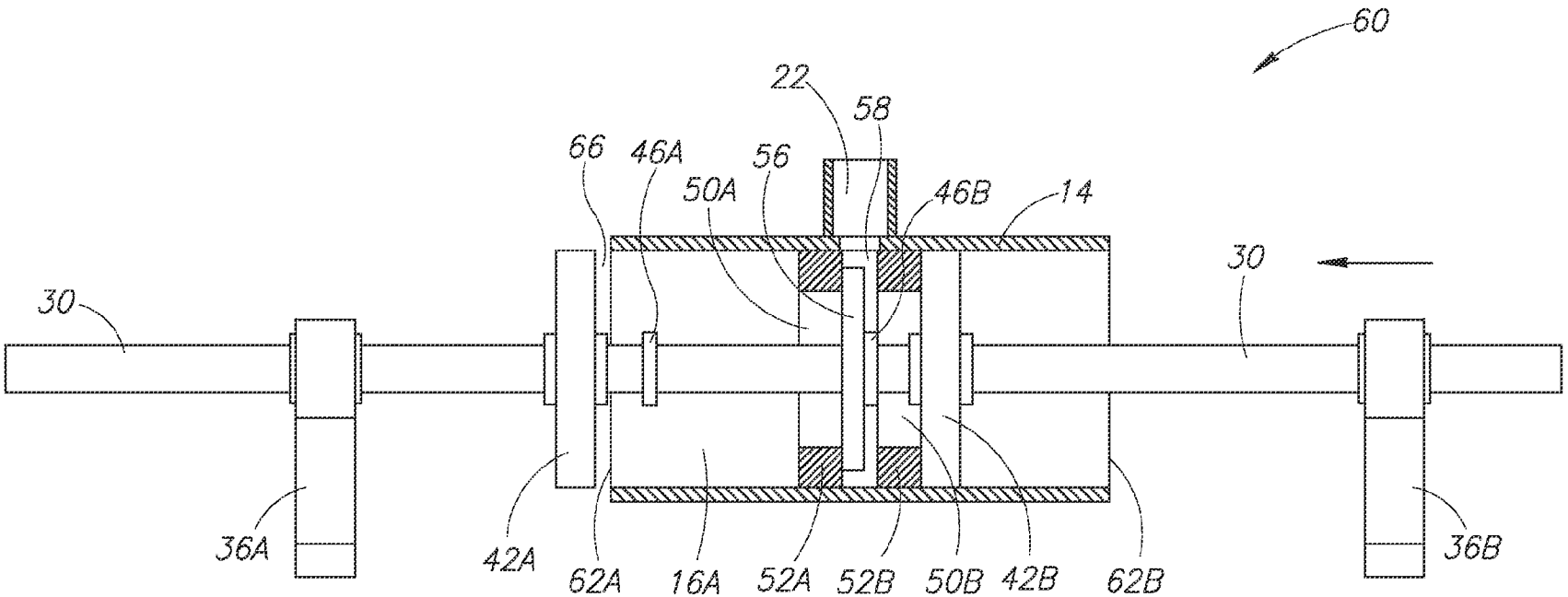
FIG. 2 illustrates an opposed cylinder, axial piston and shuttle valve fluid engine configuration in accordance with a second embodiment of the present invention.

FIG. 2 illustrates a fluid engine 60 according to a second embodiment of the present invention. The fluid engine 60 is similar to the engine 10 of FIGS. 1A-1E in many respects, so the discussion of the engine 60 is limited to its differences from the engine 10. Rather than cylinder base plates, the cylinder body 14 of the engine 60 shown in FIG. 2 includes a left open end 62A and a right open end 62B. As the piston 42A extends toward the end of its stroke, it moves past the left end 62A of the cylinder 14 to form an exhaust gap 66. The piston 42B operates the same way when it moves beyond the right open end 62B. Thus, in this configuration, there is no need for exhaust ports since the chambers 16A and 16B are opened when the pistons 42A and 42B, respectively, are moved outside of the cylinder 14 during each stroke.

FIGS. 3A-3E illustrate partial cross-sectional views of an opposed cylinder, axial piston and sliding valve expansion fluid engine 80 in accordance with a third embodiment of the present invention when the engine is in various stages of its operation cycle. The engine 80 is similar to the engine 10 of FIGS. 1A-1E in many respects, so the discussion of the engine 80 is limited to its differences from the engine 10.

In this embodiment, a valve 92 in the form of a cylinder is slidably coupled to the shaft 30. The valve 92 is sized to be positioned within aperture 86A (see FIG. 3B) and aperture 86B (see FIG. 3A) of valve guides or seats 82A and 82B, respectively. The valve 92 is movable between the two valve seats 82A and 82B by the valve drivers 46A and 46B, as described above. To restrict the movement of the valve 92 to within the valve seats 82A and 82B, sliding valve stops 48A and 48B are positioned to the outside of each of the valve seats 82A and 82B, respectively. The valve stops 48A and 48B have a smaller opening than the apertures 86A and 86B so the valve 92 is prevented from continuing its travel after opening the inlet port 22. When the valve 92 is inside one of the seats 82A and 82B, the valve forms the cylinder "head" against which the fluid and the pistons 42A and 42B act. The valve stops 48A and 48B may be constricted parts of the valve guides 82A and 82B, may be formed as "washer" plates attached to the outer ends of the valve guides 82A and 82B, or may be configured in any other suitable manner to effectively restrict the travel of the valve 92 between the valve seats 82A and 82B. Further, the valve seats 82A and 82B may be formed in any suitable manner, and may comprise one or more components having the functionality described herein.

Figure 3A:
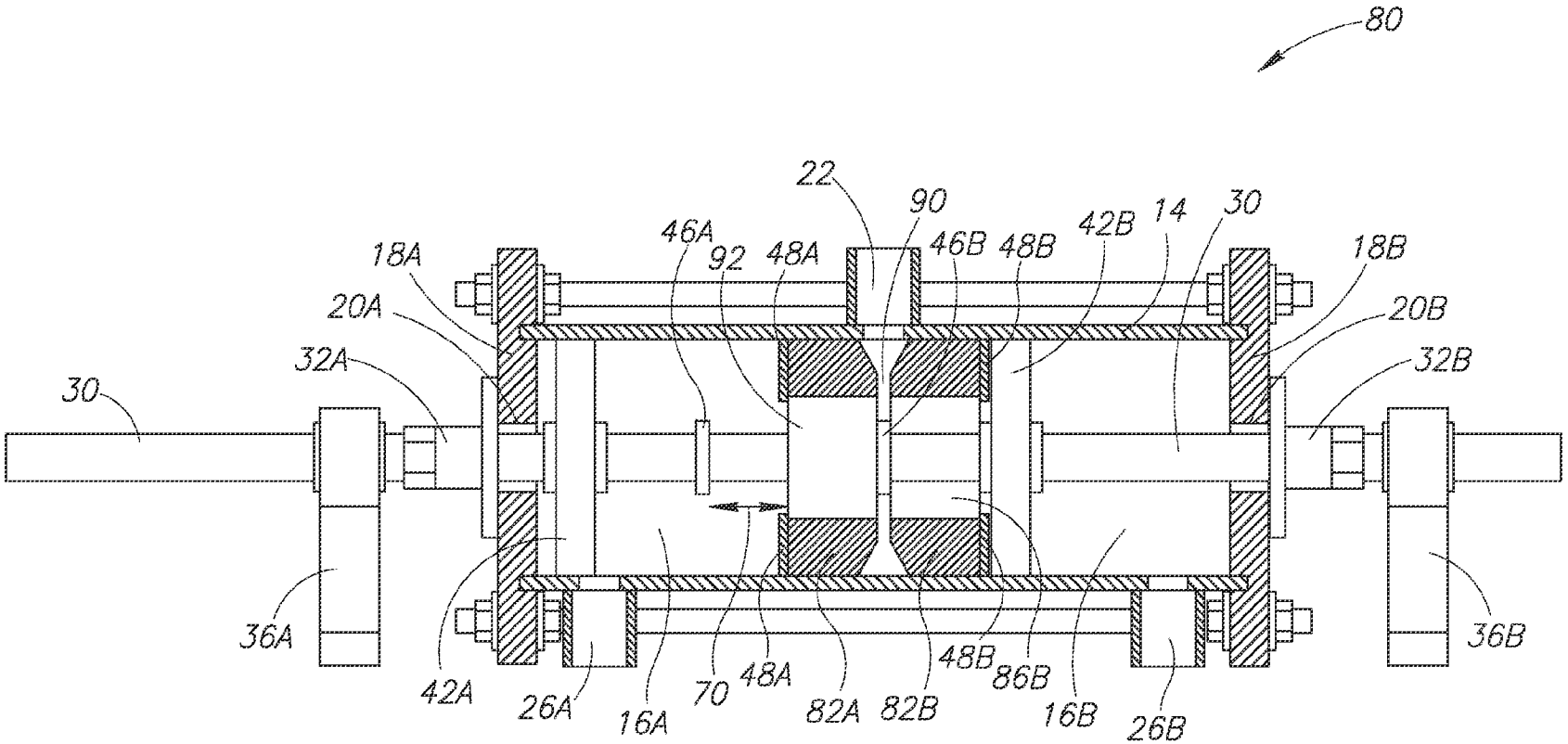
FIG. 3A illustrates an opposed cylinder, axial piston and sliding valve expansion fluid engine configuration in accordance with a third embodiment of the present invention.
Figure 3B:
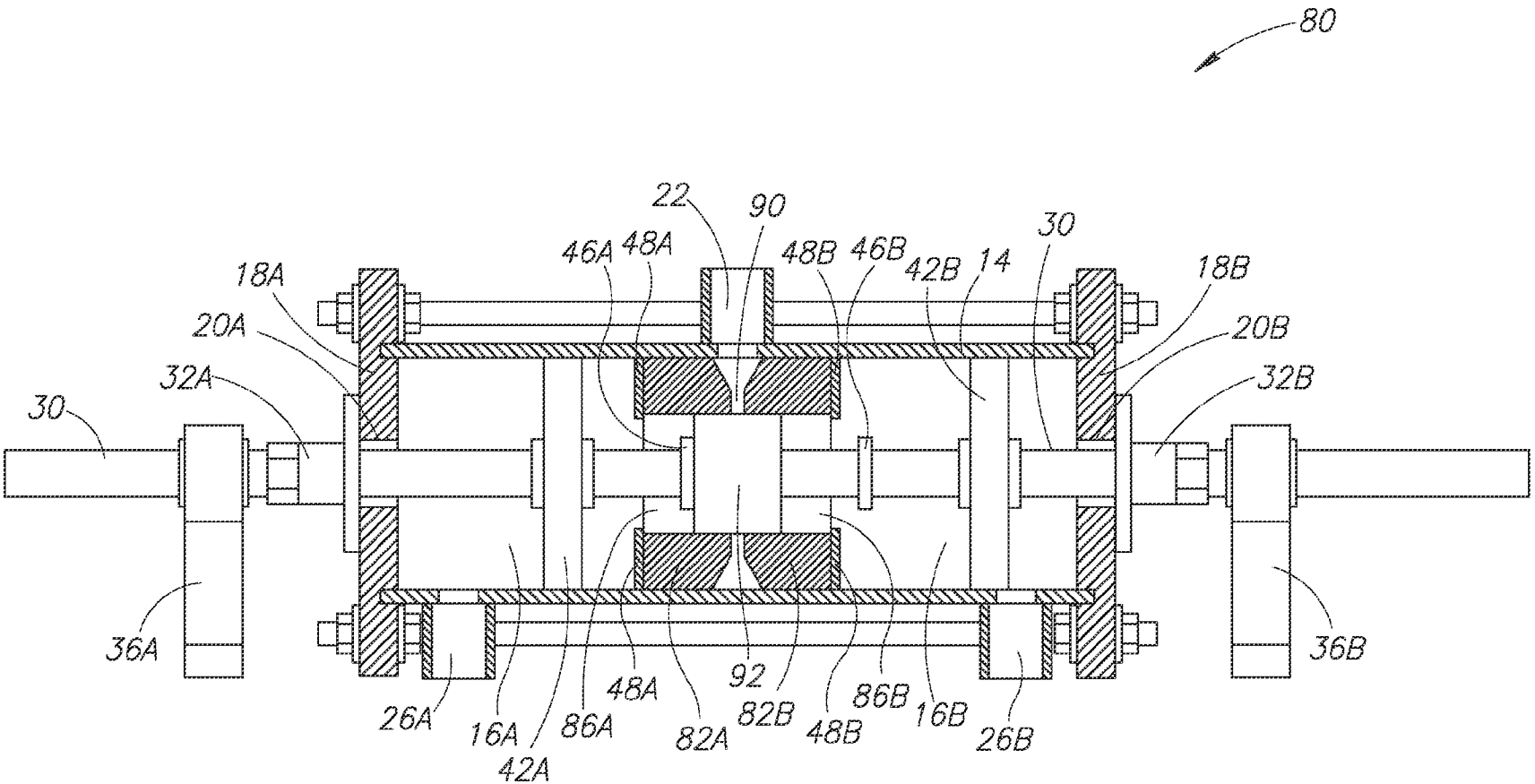
FIG. 3B illustrates the fluid engine of FIG. 3A when the right side piston is positioned between the retracted position and an extended or exhaust position during an expansion stroke.

During operation, as shown in FIG. 3A, a high-pressure expansion fluid (e.g., steam) enters the inlet port 22 and is directed by the valve 92 through an inlet fluid gap 90 to force the piston 42B toward and into the lower pressure right fluid chamber 16B of the cylinder 14. The high-pressure expansion fluid causes the piston 42B to extend away from the inlet port 22 to the right, which in turn causes the valve driver 46A to move toward the valve 92. At a predetermined point in the stroke of the piston 42B, the valve driver 46A contacts and moves the valve 92 rightward to close or "cut off" the gap 90 between the inlet port 22 and the fluid chamber 16B, as shown in FIG. 3B. This point in the stroke may be referred to as the cutoff point.

Figure 3C:
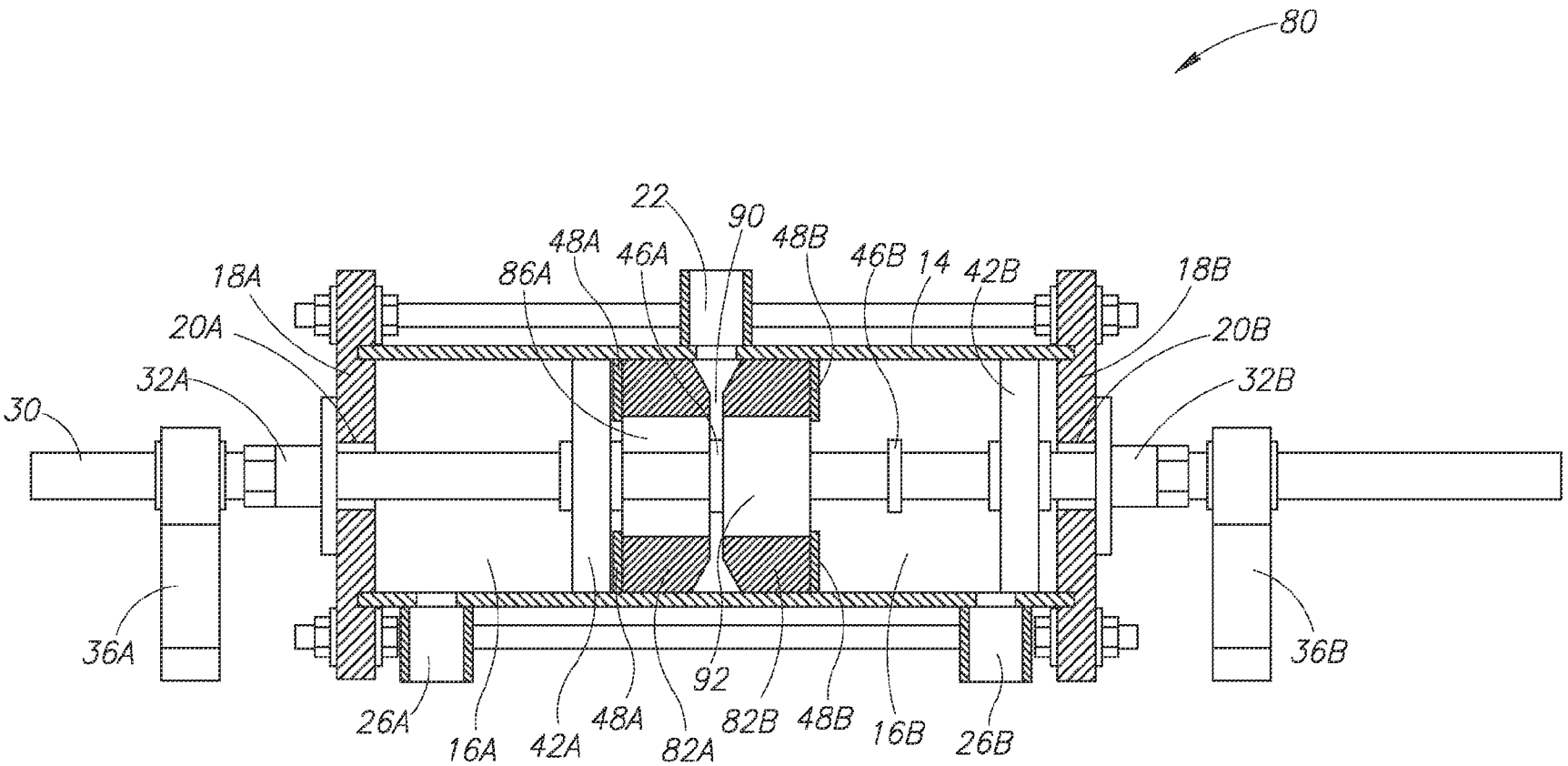
FIG. 3C illustrates the fluid engine of FIG. 3A when the right side piston is positioned in the extended position.
Figure 3D:
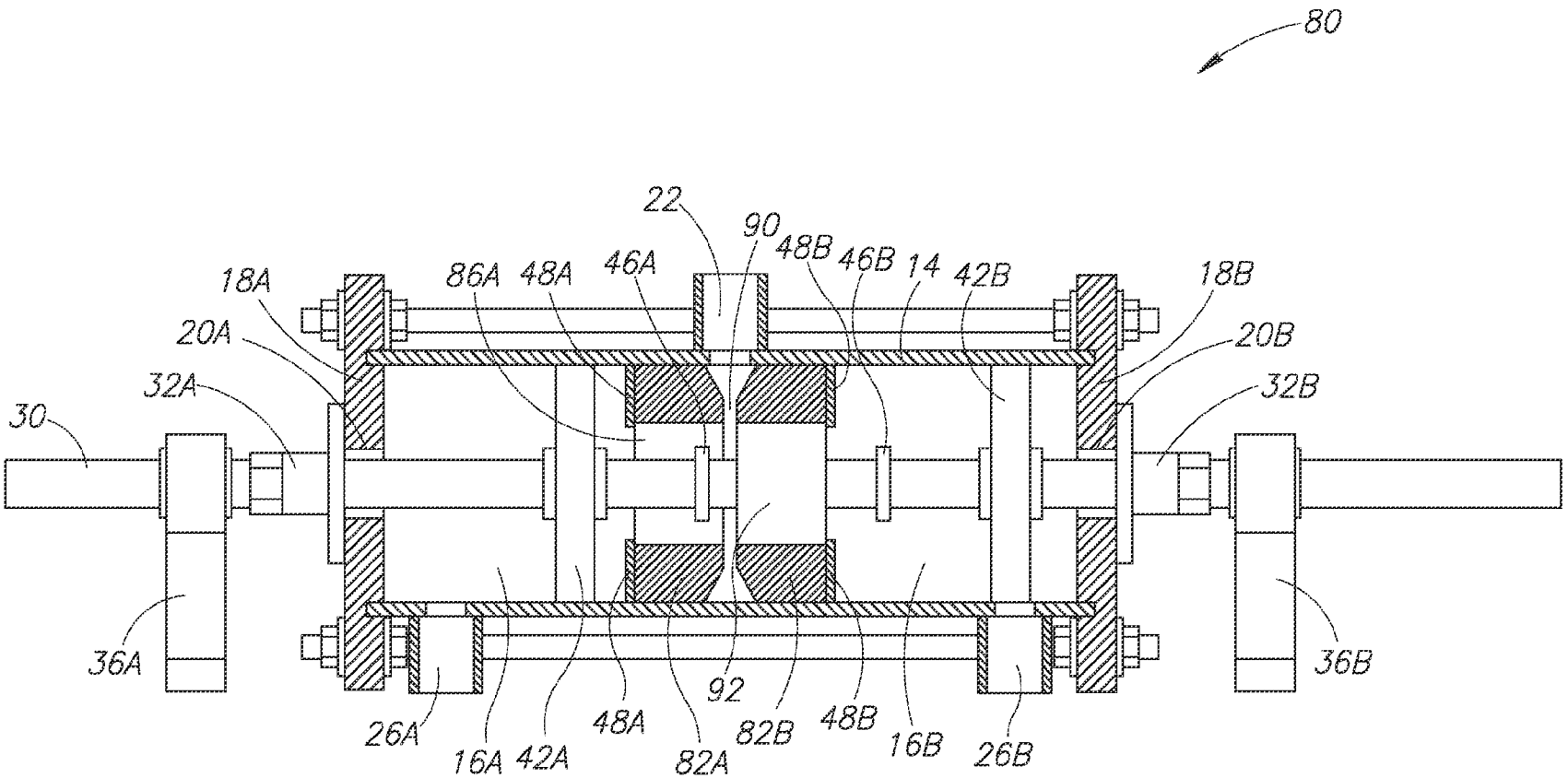
FIG. 3D illustrates the fluid engine of FIG. 3A when the right side piston is positioned between the retracted position and an extended or exhaust position during a retraction stroke.
Figure 3E:
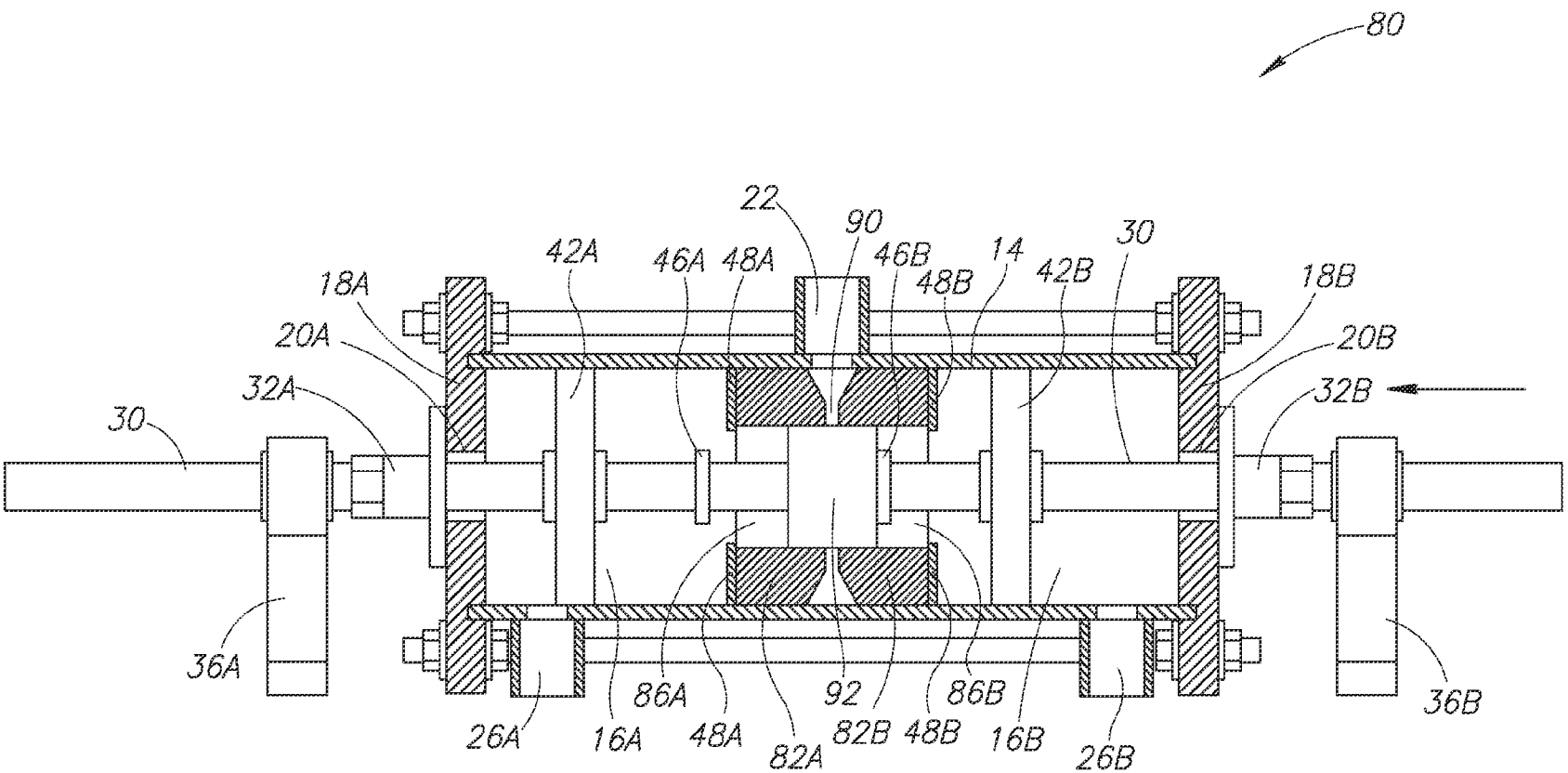
FIG. 3E illustrates the fluid engine of FIG. 3A when the right side piston is positioned near the retracted position and the shuttle valve is in a transitional state.

Since the fluid is an expansion fluid such as steam, the fluid expands after the cutoff point, forcing the piston 42B to extend past the exhaust port 26B at end of its stroke where the expansion fluid may exhaust. As shown in FIG. 3C, as the shaft 30 moves to the right, the valve driver 46A pushes the valve 92 to a second position within the aperture 86B of the right valve seat 82B wherein the flow of higher pressure fluid to the right fluid chamber 16B is cut off and the flow of higher pressure fluid toward the left fluid chamber 16A is permitted. Then, as shown in FIGS. 3D and 3E, the high pressure fluid forces the left piston 42A to expand leftward, beginning another cycle of the engine 80.

In FIG. 3A, an arrow 70 between the left valve driver 46A and the valve 92 illustrates the free travel distance of the shaft 30 and the valve driver before the valve driver begins to move the valve. This distance may be selectively chosen so that the cut off is at a desired point in the stroke of the pistons 42A and 42B. Thus, the cutoff of the engine 80 is variable. Early cutoff may be used to increase the efficiency of the engine by allowing the steam to expand for the rest of the power stroke, yielding more of its energy and conserving steam. This is known as expansive working. Late cutoff may be used to provide greater power to the shaft at the expense of efficiency. Cutoff is conventionally expressed as percentage of the power stroke of the piston. For example, if the piston is at a quarter of its stroke at the cutoff point, the cutoff is stated as 25%.

Figure 4:
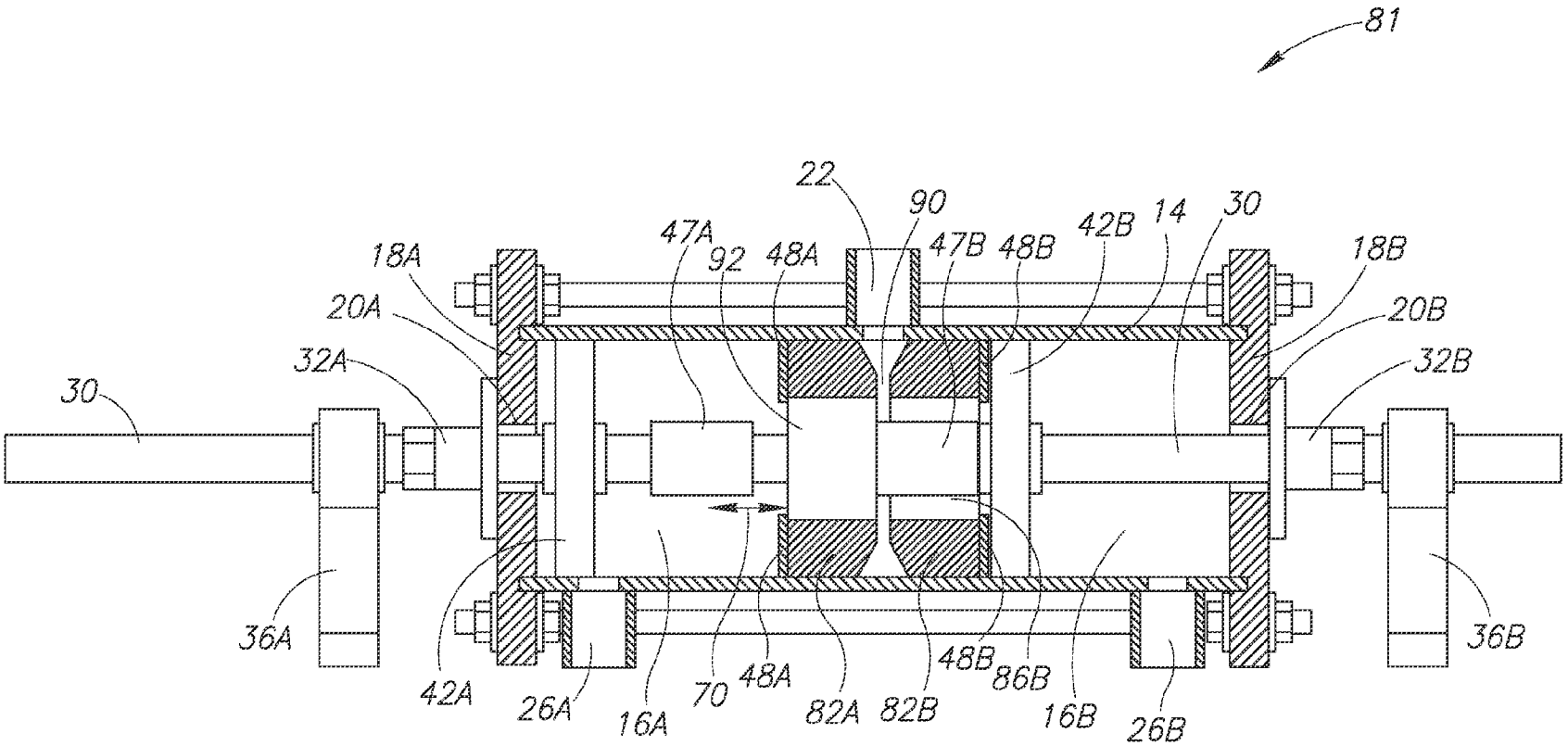
FIG. 4 illustrates an opposed cylinder, axial piston and sliding valve expansion fluid engine configuration in accordance with a fourth embodiment of the present invention.

FIG. 4 illustrates an expansion fluid engine 81 according to a fourth embodiment of the present invention. The engine 81 is substantially similar to the engine 80 shown in FIGS. 3A-3E, except that the engine 81 includes elongated, movable/sliding drivers 47A and 47B that float on the shaft 30 between the pistons 42A and 42B. In this embodiment, the moveable drivers 47A and 47B replace the shaft-affixed drivers 46A and 46B shown in FIGS. 3A-3E. Since the drivers 47A and 47B slide on either side of the sliding valve 92, there is nothing attached to the shaft 30 between the pistons 42A and 42B. To reduce hammer shock and noise, the drivers 47A and 47B may be other forms or may be composed of other materials (e.g., TEFLON®, springs, etc.).

Figure 5:
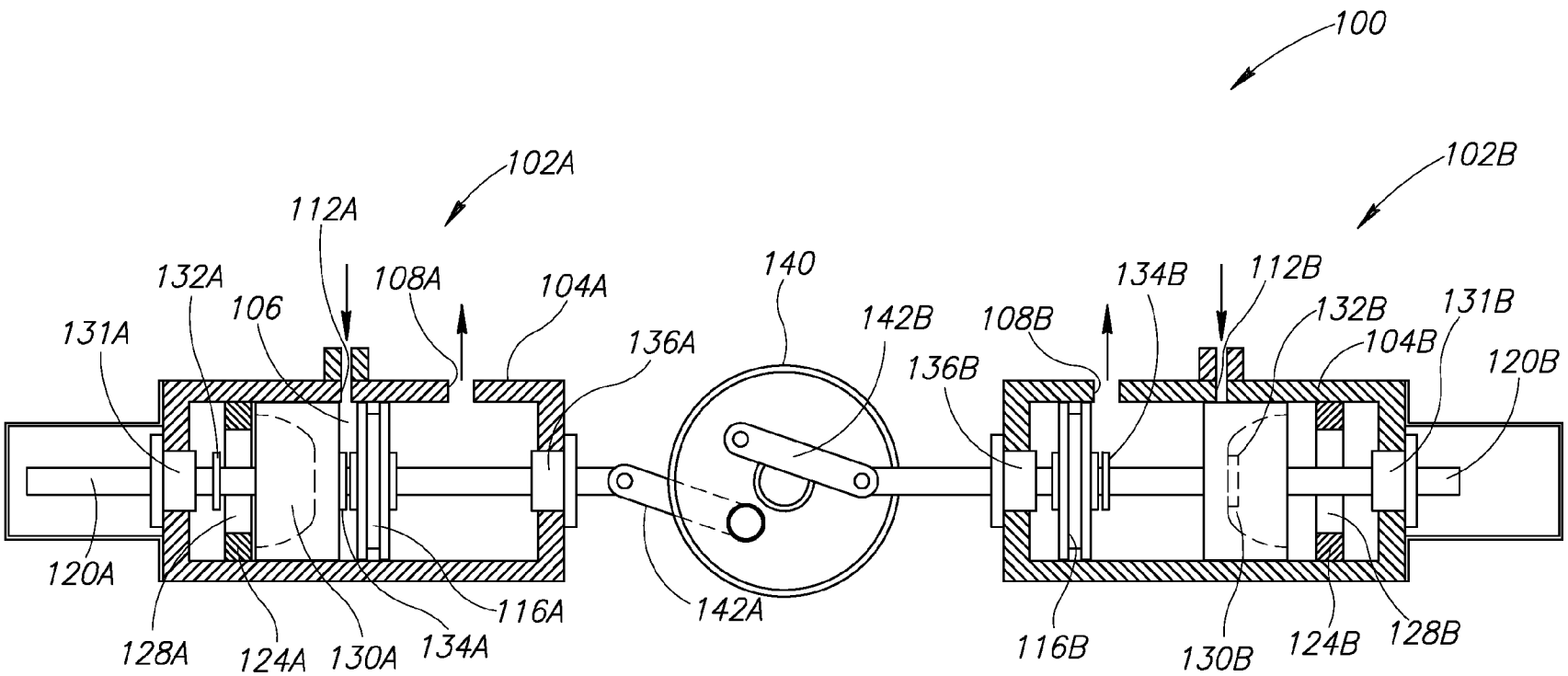
FIG. 5 illustrates two single cylinder, axial piston and sliding expansion fluid engine configuration in accordance with a fifth embodiment of the present invention.

FIG. 5 illustrates an expansion fluid engine 100 comprising a left assembly 102A and a right assembly 102B in accordance with a fifth embodiment of the present invention. A description of the components associated with the left assembly 102A is provided below. It should be appreciated that the components associated with the right assembly 102B are substantially identical to the components associated with the left assembly 102A and are identified by the same reference numerals appended with the letter "B" instead of the letter "A."

The assembly 102A comprises an elongated cylinder body 104A (or "cylinder") having a power shaft 120 coupled thereto via linear bearings or seals 131A and 136A, which allow the power shaft to reciprocate within the cylinder 104A. The shaft 120A includes a piston head 116A (or "piston") fixedly attached thereto.

The cylinder 104A also includes a valve stop 124A having an aperture 128A therethrough that is spaced apart from an inlet port 112A. The inlet port 112A may be coupled to a pressurized expansion fluid source, such as a boiler. A valve 130A is slidably coupled to the shaft 120A and is disposed between the valve stop 124A and the inlet port 112A. The valve stop 124A acts to restrict the travel of the valve 130A. As shown, an inlet fluid gap 106 is formed between the valve 130A and the piston 116A so that fluid may flow from the inlet port 112A into the gap.

A left valve driver 132A and a right valve driver 134A are fixedly positioned on the shaft 120A on opposite sides of the valve 130A. The right valve driver 134A is configured to force the valve 130A to the left until it is adjacent to the valve stop 124A so that the gap 106 is formed. The left valve driver 132A is configured to force the valve 130A to the right until it blocks or cuts off the flow of fluid into the gap 106 (see the assembly 1028 of FIG. 5).

The cylinder 104A also includes an exhaust port 108A positioned such that the piston 116A extends past the exhaust port when in an extended position such that the expansion fluid in the cylinder 104A may exhaust out of the port. This position is shown by the right assembly 1028 of FIG. 5.

During operation, high-pressure fluid enters the inlet port 112A and is directed into the gap 106 of the cylinder 104A. The high-pressure fluid causes the piston 116A to extend away from the inlet port 112A to the right until the piston extends past the exhaust port 108A near the end of its stroke. The higher pressure retains the valve 130A in its position as the piston 116A extends to the right. As the shaft 120A moves to the right, the valve driver 132A pushes the valve 130A to a second position wherein the flow of high-pressure fluid is cut off. The positioning of the valve driver 132A and the size of the valve 130A may be chosen to select the cutoff point. The expansion fluid continues to expand after cutoff and forces the piston 116A to extend rightward until the piston passes the exhaust port 108A and the expansion fluid is exhausted out of the exhaust port. The cycle is then repeated.

The assemblies 102A and 102B are arranged in an opposing configuration by having the shafts 120A and 120B pivotably coupled to connecting rods or linkages 142A and 142B, respectively, which are in turn coupled to a crankshaft 140. In other embodiments, a single piston/cylinder may be coupled to a flywheel to return the piston to its initial position after its expansion stroke.

Figure 6:
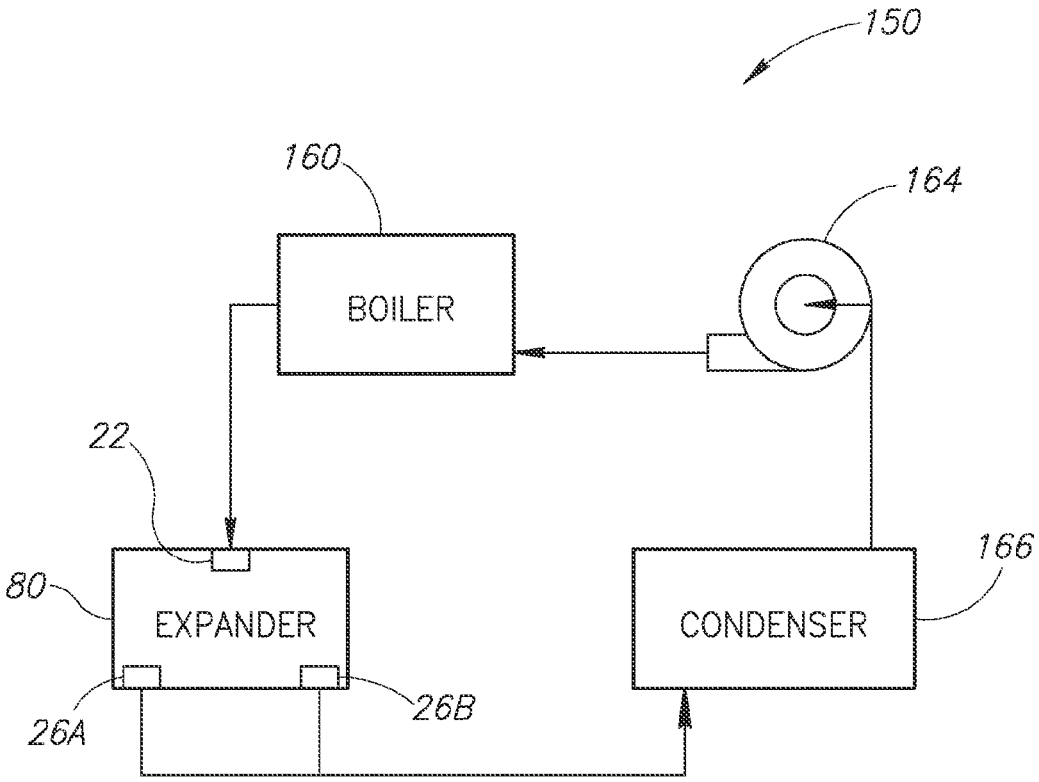
FIG. 6 illustrates the fundamental components of an example steam engine in which the embodiments of the present invention may be utilized.

FIG. 6 illustrates the fundamental components of an example steam engine 150 in which the embodiments of the present invention may be utilized. The steam engine is shown working with the engine or expander 80 shown in FIGS. 3A-3E and described above. The steam engine 150 includes a boiler 160 (or an evaporator, etc.) that converts water to high-pressure steam. In the steam cycle, water is first pumped to an elevated pressure using a feedwater pump 164. The water is then heated to the boiling temperature corresponding to the pressure and boiled (i.e., heated from liquid to vapor). In some embodiments, the water may then be superheated (i.e., heated to a temperature above that of boiling). The pressurized steam is expanded to lower pressure in the expander 80 as discussed above, and is then exhausted into a condenser 166. The condensate from the condenser 166 is returned to the pump 164 for continuation of the cycle.

The engines of the present invention may be arranged as a simple or compound engine, in a radial configuration, etc. The engines may be arranged in series with connected shafts or in parallel through a simple connecting link or through a crankshaft. The engines may be used to power a crankshaft, linear generator, or other output production. For example, the engine may be used as part of a solar steam consumer power plant.

It will be appreciated that the embodiments of the present invention provide several advantages. First, since the steam/heat flows in one direction within the cylinders (uniflow) rather than entering and exiting from substantially the same cylinder area (counterflow), higher thermal efficiencies are achieved. Second, by utilizing shaft concentric piston operated intake and piston exhaust valves, economy of material, labor, and parts is achieved. Third, by providing external piston shaft support bearings, critical alignment is maintained while reducing friction by not using the pistons as linear bearings. The external bearings also eliminate internal lubrication and remain cooler during operation. Fourth, by utilizing intake valves that are slidably mounted to the shaft, there is no need for ancillary valve linkages as required in conventional steam engines. Further, the twin, opposing configuration discussed above requires no flywheel and supports self-starting. The opposing configuration also facilitates sharing of a single intake valve between two opposed cylinders.

Examples of a few of the problems solved by one or more embodiments of the present invention are discussed below.

Problem: Oil and Water Blending

In conventional fluid engines, the internal crankcase throws lubrication oil onto the cylinder walls since the piston is used as an internal linear bearing. This configuration combines steam and lubrication products, which require closed-loop condensate separation and filtering processes.

In embodiments of the present invention, the axial piston and valve shaft fluid engine has main bearings mounted outside the cylinder and away from steam operations.

Problem: Cost

The traditional fluid engine is costly. It has external valves and valve cams, rods, shaft and linkages. The dual cylinder engine usually has two intake valve sets. Traditional fluid engines use pistons as internal, large-diameter friction surface linear bearings. Increased energy is required to overcome additional friction.

Embodiments of the axial piston and valve shaft fluid engines of the present invention have a single piston-operated sliding intake valve. The pistons also act as two-stroke exhaust port valves. Thus, no external valve linkages are required. As can be appreciated, fewer moving parts reduce friction and costs. Additionally, small diameter (shaft) linear bearings, positioned external to the cylinder, have little friction and require only external lubrication. Further, a single moving assembly (i.e., pistons as exhaust valves, shaft, and intake valve) can also significantly reduce manufacturing and maintenance costs.

Problem: Crankcase Condensation

In conventional steam engines, steam blows by the piston rings into the crankcase and mixes into the lubrication products.

Embodiments of the axial piston and valve shaft fluid engine of the present invention can be a closed steam system with exhaust ports/manifold preserving condensate in the fluid cycle. External or separately enclosed cranks and flywheel(s) may be used without mixing the working fluid with lubrication material.

Problem: Considerable Piston Blow-by (or Severe Piston Ring Tension)

The axial shaft and external bearing set of embodiments of the present invention are operative to maintain critical tolerances and gaps. For example, polytetrafluoroethylene (PTFE) piston-cylinder wall wipers may be used to provide low friction seals.

Problem: Linear Engine Requires Crankshaft to Turn Generator

Solution: A "free piston" boxer type (spool piston) engine, without added crosshead or crankshaft, lends itself to linear alternator electricity generation. A specifically designed alternator may be used to maintain the engine in a shut down, self-starting, end of stroke position.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

What is claimed is:

1. A fluid engine comprising:

a cylinder having a fluid chamber, an inlet port couplable to a fluid source for porting fluid into the fluid chamber, and an outlet port for porting fluid out of the fluid chamber;

a power shaft configured for reciprocal movement with respect to the cylinder;

a piston fixedly coupled to the power shaft and slidable in the cylinder;

an intake valve slidably coupled to the power shaft within the cylinder, the intake valve being movable between a first position wherein a passage is formed between the inlet port and the fluid chamber to permit the flow of fluid from the inlet port into the fluid chamber, and a second position wherein the intake valve closes the passage to prevent the flow of fluid from the inlet port into the fluid chamber;

a first valve driver coupled to the power shaft on a first side of the intake valve, the first valve driver being configured to move the intake valve from the first position into the second position in response to movement of the power shaft; and a second valve driver coupled to the power shaft on a second side of the intake valve opposite the first side, the second valve driver being configured to move the intake valve from the second position into the first position in response to movement of the power shaft.

2. The fluid engine of claim 1, further comprising linear bearings coupled to the power shaft and disposed external to the cylinder, the linear bearings configured to support the power shaft and to maintain the alignment thereof relative to the cylinder.

3. The fluid engine of claim 1, wherein the piston is extendable past the outlet port such that the piston is operable as an outlet valve.

4. The fluid engine of claim 1, wherein the outlet port comprises an open end of the cylinder and, during operation, the piston is extendable past the open end.

5. The fluid engine of claim 1, further comprising a valve seat disposed within the cylinder between the inlet port and the piston, the valve seat comprising an aperture, wherein the intake valve comprises a shuttle plate configured to cover the aperture of the valve seat when the intake valve is in the second position.

6. The fluid engine of claim 1, further comprising a valve seat disposed within the cylinder between the inlet port and the piston, the valve seat comprising an aperture, wherein the intake valve is in the form of a cylinder configured to slide within the aperture of the valve seat.

7. The fluid engine of claim 1, wherein the intake valve and the first valve driver are configured to permit the intake valve to cutoff the passage partway through an expansion stroke of the piston.

8. The fluid engine of claim 1, wherein the first valve driver and the second valve driver are slidably coupled to the power shaft.

9. The fluid engine of claim 1, wherein the first valve driver and the second valve driver are fixedly coupled to the power shaft.

10. The fluid engine of claim 1, wherein the inlet port and the outlet port are spaced apart such that fluid flows in one direction in the cylinder.

11. A fluid engine comprising:

a cylinder body comprising a first fluid chamber and a second fluid chamber, an inlet port for porting fluid into the first and second fluid chambers positioned between the first fluid chamber and the second fluid chamber, a first outlet port for porting fluid out of the first fluid chamber, and a second outlet port for porting fluid out of the second fluid chamber;

a power shaft configured for reciprocal movement with respect to the cylinder body;

a first piston fixedly coupled to the power shaft and slidable within the first fluid chamber;

a second piston fixedly coupled to the power shaft and slidable within the second fluid chamber;

an intake valve slidably coupled to the power shaft within the cylinder, the intake valve being movable between a first position wherein a first passage is formed between the inlet port and the first fluid chamber to permit fluid flow from the inlet port into the first fluid chamber and to block fluid flow between the inlet port and the second fluid chamber, and a second position wherein a second passage is formed between the inlet port and the second fluid chamber to permit fluid flow from the inlet port into the second fluid chamber and to block fluid flow between the inlet port and the first fluid chamber;

a first valve driver coupled to the power shaft on a first side of the intake valve, the first valve driver being configured to move the intake valve from the first position into the second position in response to movement of the power shaft; and a second valve driver coupled to the power shaft on a second side of the intake valve opposite the first side, the second valve driver being configured to move the intake valve from the second position into the first position in response to movement of the power shaft.

12. The fluid engine of claim 11, further comprising linear bearings coupled to the power shaft and disposed external to the cylinder body, the linear bearings configured to support the power shaft and to maintain the alignment thereof relative to the cylinder body.

13. The fluid engine of claim 11, wherein the first and second pistons are extendable past the first and second outlet ports, respectively, such that the pistons are operable as outlet valves.

14. The fluid engine of claim 11, wherein the first outlet port comprises a first open end of the cylinder body and the second outlet port comprises a second open end of the cylinder body opposite the first open end and, during operation, the first piston is extendable past the first open end, and the second piston is extendable past the second open end.

15. The fluid engine of claim 11, further comprising a first valve seat disposed within the cylinder body between the inlet port and the first piston, and a second valve seat disposed within the cylinder body between the inlet port and the second piston, the first and second valve seats each comprising an aperture, wherein the intake valve comprises a shuttle plate disposed between the first and second valve seats and configured to cover the aperture of the second valve seat when the intake valve is in the first position, and to cover the aperture of the first valve seat when the intake valve is in the second position.

16. The fluid engine of claim 11, further comprising a first valve seat disposed within the cylinder body between the inlet port and the first piston, and a second valve seat disposed within the cylinder body between the inlet port and the second piston, the first and second valve seats each comprising an aperture, wherein the intake valve comprises a cylinder slidable within the first and second valve seats.

17. The fluid engine of claim 16, wherein the intake valve is configured to cutoff the fluid passages to each of the first fluid chamber and the second fluid chamber partway through an expansion stroke of the first piston and the second piston, respectively.

18. The fluid engine of claim 11, wherein the first valve driver and the second valve driver are slidably coupled to the power shaft.

19. The fluid engine of claim 11, wherein the first valve driver and the second valve driver are fixedly coupled to the power shaft.

20. The fluid engine of claim 11, wherein the first and second outlet ports are each spaced apart from the inlet port such that fluid flows in one direction in each of the first and second fluid chambers.

21. An expansion fluid engine comprising:

a fluid heating apparatus configured to vaporize an expansion fluid;

an expander comprising:

a cylinder body comprising a first fluid chamber and a second fluid chamber, an inlet port coupled to the fluid heating apparatus for porting high-pressure vaporized fluid into the first and second fluid chambers positioned between the first fluid chamber and the second fluid chamber, a first outlet port for porting low-pressure vaporized fluid out of the first fluid chamber, and a second outlet port for porting low-pressure vaporized fluid out of the second fluid chamber;

a power shaft configured for reciprocal movement with respect to the cylinder body;

a first piston fixedly coupled to the power shaft and slidable within the first fluid chamber;

a second piston fixedly coupled to the power shaft and slidable within the second fluid chamber;

an intake valve slidably coupled to the power shaft within the cylinder, the intake valve being movable between a first position wherein a first passage is formed between the inlet port and the first fluid chamber to permit fluid flow from the inlet port into the first fluid chamber and to block fluid flow between the inlet port and the second fluid chamber, and a second position wherein a second passage is formed between the inlet port and the second fluid chamber to permit fluid flow from the inlet port into the second fluid chamber and to block fluid flow between the inlet port and the first fluid chamber;

a first valve driver coupled to the power shaft on a first side of the intake valve, the first valve driver being configured to move the intake valve from the first position into the second position in response to movement of the power shaft; and a second valve driver coupled to the power shaft on a second side of the intake valve opposite the first side, the second valve driver being configured to move the intake valve from the second position into the first position in response to movement of the power shaft;

a condenser coupled to the first and second output ports operative to receive the low-pressure vaporized fluid from the expander and to form a condensate; and a pump coupled to the condenser and the fluid heating apparatus configured to receive the condensate from the condenser and to pump liquid fluid to the fluid heating apparatus.

* * * * *

UNITED STATES PATENT AND TRADEMARK OFFICE

CERTIFICATE OF CORRECTION

PATENT NO. : 8,474,363 B2
APPLICATION NO. : 13/476365
DATED : July 2, 2013
INVENTOR(S) : Vincent M. Kelly It is certified that error appears in the above-identified patent and that said Letters Patent is hereby corrected as shown below:

Title Page:

OTHER PUBLICATIONS should read "Web Page: http://home.earthlink.net/~dlaw70/12stmng.htm"

In the Specification:

Column 6, line 11 should read "assembly 102B of FIG. 5)."

Column 6, line 16 should read "position is shown by the right assembly 102B of FIG. 5."

Signed and Sealed this
Seventeenth Day of September, 2013

Teresa Stanek Rea
*Deputy Director of the United States Patent and Trademark Office*